United States Patent [19]

Dijkmans et al.

[11] 4,371,748

[45] Feb. 1, 1983

[54] DEVICE FOR ARTIFICIAL REVERBERATION

[75] Inventors: Eise C. Dijkmans; Kornelis A. Immink, both of Eindhoven, Netherlands

[73] Assignee: U.S. Philips Corporation, New York, N.Y.

[21] Appl. No.: 140,269

[22] Filed: Apr. 14, 1980

[30] Foreign Application Priority Data

Apr. 24, 1979 [NL] Netherlands ..... 7903196

[51] Int. Cl.[3] ..... G10K 11/00

[52] U.S. Cl. ..... 179/1 J

[58] Field of Search ..... 179/1 J; 84/DIG. 26, 84/1.25

[56] References Cited

FOREIGN PATENT DOCUMENTS 2855278 7/1979 Fed. Rep. of Germany ..... 179/1 J

*Primary Examiner*—Joseph A. Popek

*Attorney, Agent, or Firm*—Robert T. Mayer; Bernard Franzblau

[57] ABSTRACT

An artificial reverberation device comprising first, second, third and fourth delay lines and first and second adder circuits with at least a part of said first, second, third and fourth delay lines connected in a cascade arrangement with the first and second adder circuits. First and second feedback circuits and first and second transmission paths are coupled to the cascade arrangement so as to produce a multiple reverberation effect with a minimum number of components.

17 Claims, 4 Drawing Figures

DEVICE FOR ARTIFICIAL REVERBERATION

BACKGROUND OF THE INVENTION

The invention relates to a device for artificial reverberation comprising the series connection of first and second delay line having equal delay times and, included between said delay lines, an adding circuit to which the input signal of the first and the output signal of the second delay line are applied with the required strength and with mutually opposite polarity. Such a device is known from British Pat. No. 2,012,147.

It is an object of the invention to realize a multiple reverberation with a minimal number of additional components. In this respect multiple reverberation is to be understood to mean that in addition to the delay time determined by the first or the second delay line, further delay times are introduced into the device so that an acoustic simulation is obtained of an effect similar to that of the sound being reflected by different walls at different distances from the sound source. In known devices such an effect is obtained by connecting a plurality of fed back delay lines one after another. As a result of this the number of memory locations required becomes considerable, or if said delay lines take the form of charge transfer devices the number of charge storage locations in such charge transfer devices becomes rather substantial.

SUMMARY OF THE INVENTION

The invention is characterized in that at least one of said delay lines consists of a series connection of a first and a second delay line section, that the device further comprises a third delay line and a second adder circuit, that one of the delay line sections, as the case may be via a fifth delay line, is connected in series with the second adder circuit and the third delay line, the delay time of the third delay line being equal to the sum of the delays of said delay line section and the fifth delay line, the signals on the ends of the relevant delay line section and the third delay line which are remote from said second adder circuit being applied to the second adder circuit with the required strength and with mutually opposite polarity.

Owing to the steps in accordance with the invention the sum of the delay times of the total number of delay lines is limited to slightly more than twice the delay time produced by the delay line producing the greatest delay or the number of memory locations corresponding to said sum is limited to slightly more than twice the number of memory locations corresponding to the maximum delay to be realised in the device.

BRIEF DESCRIPTION OF THE DRAWINGS

The invention will be described in more detail with reference to the accompanying drawing in which.

DETAILED DESCRIPTION OF THE INVENTION

Figure 1:
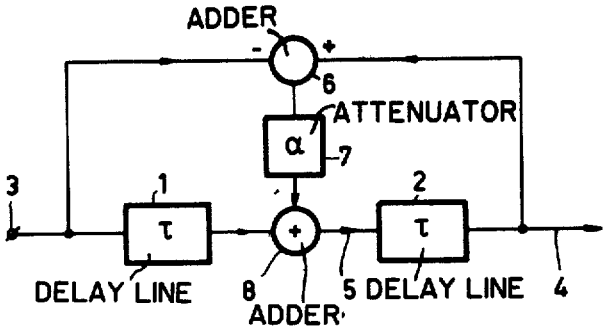
FIG.1 PRIOR ART
FIG. 1 represents a device in accordance with the prior art.

The device of FIG. 1 comprises a first delay line 1 and a second delay line 2 having equal delay times, for example a charge transfer device such as a bucket brigade or a charge coupled device. These delay lines may be preceded or followed by amplifiers, but for the sake of convenience it is assumed that the delay lines merely cause a signal delay and no loss of gain. The signal to be delayed is applied to an input 3 and at option taken from either an output 4 or an output 5. The signals at points 3 and 4 are applied with mutually opposite polarity to an adder 8 via an adder 6 and an attenuator 7, which adder 8 is included between the delay lines 1 and 2. The attenuator 7 has a transmission factor slightly smaller than 1; for example 0.7. If amplifiers are included the signal amplitude should be adapted accordingly.

As is demonstrated in the aforesaid British patent, if the requirement is met that the ratio of the transmission factor from the input 3 to the adder 8 via the adder 6 and attenuator 7, to the transmission factor from input 3 to adder 8 via delay line 1, is equal to but of a sign opposite to the loop gain from point 5 to the input of adder 8 via delay line 2, adder 6 and attenuator 7, the device will exhibit not only a flat frequency response from input to output, but also internally. Moreover, if the gain factors of the delay lines 1 and 2 are unity, the amplitude of the signal to be processed by the delay lines will remain the same, so that an optimum signal-to-noise ratio can be obtained.

Figure 2:
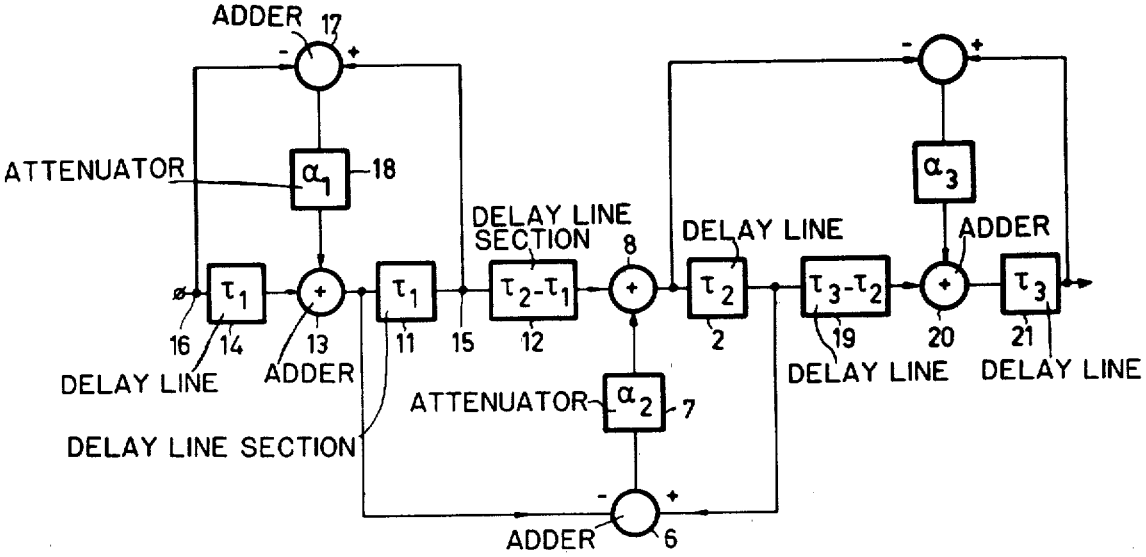
FIG. 2 shows a first embodiment.

In the embodiment of FIG. 2 the first delay line has been divided into the series connection of two delay line sections 11 and 12, the delay line section 11, in a similar way as in FIG. 1, being connected in series with an adder 13 and a third delay line 14 having the same delay time as the delay line section 11. To the adder 13 are applied the signals on those ends 15 and 16 of the lines 11 and 14 respectively which are remote from the adder, and with mutually opposite polarity (via the adder 17) and with the correct strength (via the attenuator 18).

In a similar way the delay line 2 may form part of a delay line 2+19, which is connected in series with an adder 20 and a fourth delay line 21. To the adder 20 are applied the signals on those ends of the lines 2+19 and 21 respectively which are remote from said adder, and with mutually opposite polarity and with the required strength. The maximum delay time occurring in the device is that of the line 21=that of the line 2+19. Owing to the special circuit arrangement of the device in accordance with the invention only a few more delay lines or memory locations are required because the delay times of the other lines 11+12 (=those of 2) and 14 (=that of 11) are respectively smaller and much smaller than that of 21.

Alternatively, a configuration in accordance with FIG. 2 is possible in which a sixth delay line is included in the chain directly after adder 13 and before the tapping to adder 6. In that case the requirement should be met that the delay time of delay line 14 corresponds to the sum of the delay times of the sixth delay line and of delay line section 11. Similarly, a fifth delay line may be included directly after adder 8 and before the tapping. In that case the sum of the delays of the delay line sections 11 and 12 should be equal to the sum of the delays of the fifth delay line and of delay line 2. These configurations also require less memory locations than an arrangement in which three devices in accordance with FIG. 1 are arranged one after another.

Thus, the embodiment of FIG. 2 comprises a first delay means (either delay line 21 or delay line 2), a second delay means (delay lines 2 and 19 or delay lines 11 and 12), a third delay means (delay line 2 or delay line 11) and a fourth delay means (delay lines 11 and 12 or delay line 14). A first feedback circuit (e.g. the connection from the output of delay line 21 to an input of adder 20 via the adder-subtractor and the attenuator or the connection from the output of delay line 2 to an input of adder 8 via adder-subtractor 6 and attenuator 7) and a second feedback circuit (e.g. the connection from the output of delay line 2 to an input of adder 8 via adder-subtractor 6 and attenuator 7 or the connection from point 15 to an input of adder 13 via adder-subtractor 17 and attenuator 18) are included in the embodiment of FIG. 2. Also included are a first circuit point (i.e. the junction point between adder 8 and delay line 2 or the junction point between adder 13 and delay line 11) and a second circuit point (i.e. the junction point between adder 13 and delay line 11 or the junction point 16 at the input of delay line 14). FIG. 2 further comprises a first transmission path (i.e. the connection from the output of adder 8 to an input of adder 20 via the adder-subtractor and the attenuator or the connection from the output of adder 13 to an input of adder 8 via adder-subtractor 6 and attenuator 7) and a second transmission path (i.e. the connection from the output of adder 13 to an input of adder 8 via the elements 6 and 7 or the connection from point 16 to an input of adder 13 via adder-subtractor 17 and attenuator 18). Delay line 2 or delay line 11 may constitute an input portion of the second delay means.

Figure 3:
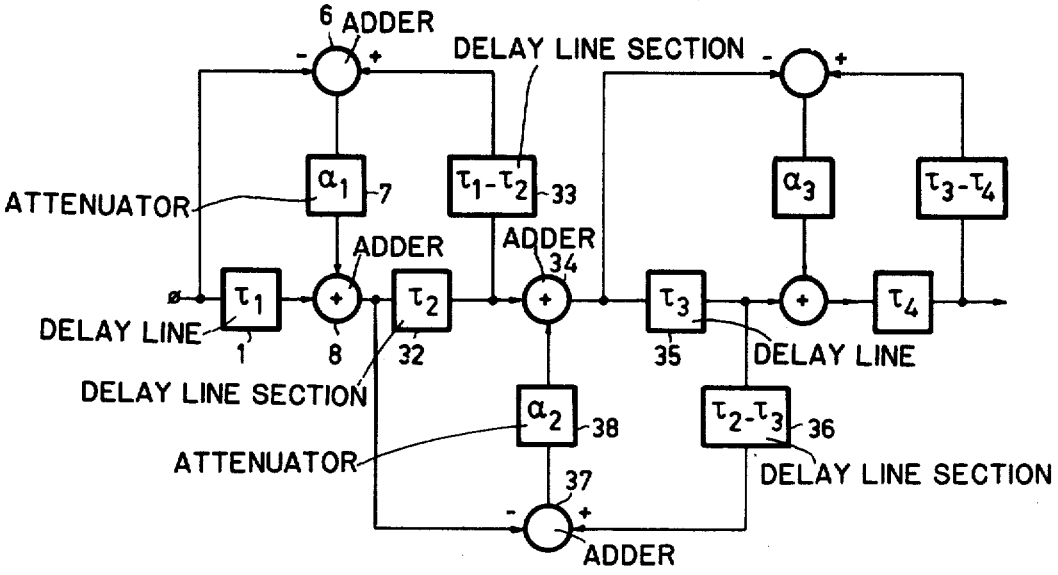
FIGS. 3 and 4 respectively show a second and a third embodiment of the invention.

In the variant of FIG. 3 the line 2 of FIG. 1 comprises two delay line sections 32 and 33, the first-mentioned section being connected in series with an adder 34 and a fifth delay line 35 and together with the delay line 36, the adder 37 and the attenuator 38 constituting a similar device as in FIG. 1. The delay time of the line 1 = that of 32+33, that of 32 = that of 35+36. The process may be repeated at libitum as the Figure shows.

Alternatively, a configuration in accordance with FIG. 3 is possible in which directly before adder 34 and after the tapping to delay line section 33 a fifth delay line is included and after the tapping to delay line section 36 and before the next adder a sixth delay line is included. The delay times should then be adapted as explained with reference to FIG. 2. Also in this case the number of memory locations is smaller than in a configuration in which three devices in accordance with FIG. 1 are arranged after each other.

The artificial reverberation apparatus of FIG. 3 comprises a first delay means including delay line sections 35 and 36, a second delay means 32, a third delay means made up of delay line sections 32 and 33, i.e. the third delay means 32, 33 includes the second delay means 32. A fourth delay means 1 having the same delay as the third delay means has its output coupled to the input of the second delay means 32 via an adder 8. A first circuit point (junction between adder 8 and the second delay means 32) is coupled to the input delay section 35 of the first delay means 35, 36 via the second delay means 32 and adder 34, and also via a first transmission path including adder-subtractor 37, attenuator 38 and adder 34. A first feedback circuit including elements 37, 38 and 34 couples the output of the first delay means 35, 36 to an input thereof. A second feedback circuit including adder-subtractor 6, attenuator 7 and adder 8 couples the output of the third delay means 32, 33 to an input thereof. A second circuit point (input terminal) is coupled to an input of the third delay means via a second transmission path including elements 6, 7 and 8 and also via a separate path including the fourth delay means 1 and the adder 8. The delay line sections $\tau_4$ and $\tau_3-\tau_4$ together make up a fifth delay means and delay line section 35 comprises a sixth delay means that is a portion of the first delay means. A third circuit point, i.e. the junction between adder 34 and the delay line section 35, is coupled to the input of the fifth delay means via a third transmission path including the unlabelled adder-subtractor, the attenuator $\alpha_3$ and the unlabelled adder between delay line 35 and delay line $\tau_4$.

Figure 4:
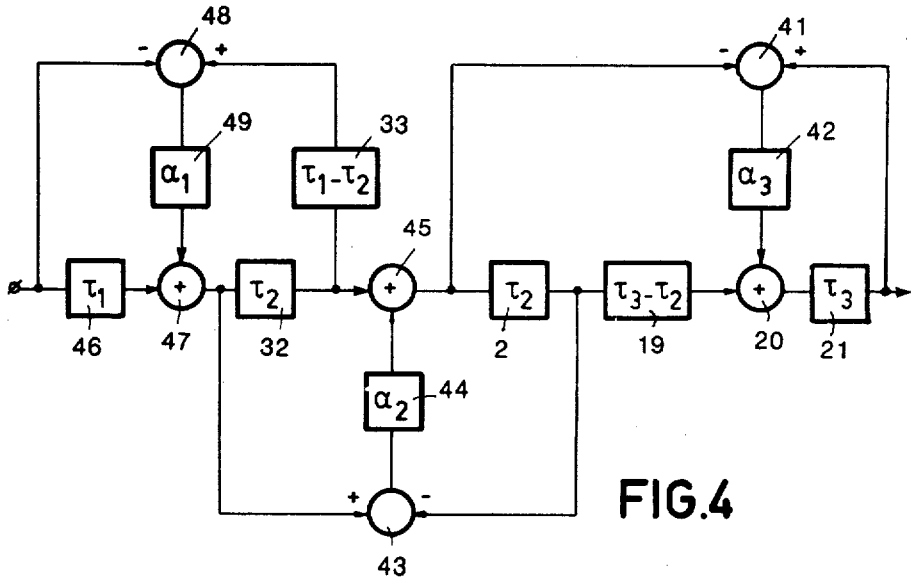

At option the operation in accordance with the left hand part of FIG. 2 may be applied to the one delay line in FIG. 1 and that in accordance with FIG. 3 to the other delay line in FIG. 1, as is shown in FIG. 4.

FIG. 4 shows a first delay means 21, a second delay means including, in cascade, delay line sections 2 and 19 where delay line 2 may also be a third delay means. A fourth delay means 32 is connected directly between the two adder devices 47 and 45. The output of the first delay means 21 is coupled to an input thereof via a first feedback circuit including adder-subtractor 41, attenuator 42 and adder 20. A first circuit point between adder 45 and delay line 2 is coupled to the input of the first delay means 21 via a first transmission path including elements 41, 42 and 20. A second circuit point between adder 47 and the fourth delay means 32 is coupled to the input of delay line section 2 via a second transmission path including adder-subtractor 43, attenuator 44 and adder 45 and also via a separate path including the fourth delay means 32 and adder 45. A second feedback circuit including elements 43, 44 and 45 couples the output of the third delay means 2 to an input thereof.

Alternatively, the delay line sections 32 and 33 may comprise the third delay means and in this case the delay line section 46 constitutes the fourth delay means. In this case, the second circuit point is the input terminal and the second transmission path includes elements 48, 49, and 47 and the second feedback circuit also includes elements 48, 49 and 47 coupling the output of the third delay means 32, 33 to an input thereof. The first delay means is still delay lines section 21 and the second delay means is still delay lines sections 2 and 19. The first feedback circuit and the first transmission path are also as described in the first embodiment of FIG. 4, as is the first circuit point, i.e. the junction of adder 45 and delay line 2.

What is claimed is:

1. Artificial reverberation apparatus comprising first delay means, a first feedback circuit coupling an output of said first delay means to an input thereof to give a feedback factor of less than 1, second delay means having the same delay as does said first delay means and which couples a first circuit point to the input of said first delay means, a first transmission path coupling said first circuit point to the input of said first delay means so as to circumvent said second delay means, the ratio of the transmission factor of the signal path from said first circuit point to the input of said first delay means via said first transmission path to the transmission factor of the signal path from said first circuit point to the input of said first delay means via said second delay means being equal but opposite to said feedback factor, third delay means comprising an input portion of the second delay means, a second feedback circuit coupling an output of said third delay means to an input thereof to give a second feedback factor of less than 1, fourth delay means having the same delay as does said third delay means and which couples a second circuit point to the input of said third delay means, and a second transmission path which couples said second circuit point to the input of said third delay means so as to circumvent said fourth delay means, the ratio of the transmission factor of the signal path from said second circuit point to the input of said third delay means via said second transmission path to the transmission factor of the signal path from said second circuit point to the input of said third delay means via said fourth delay means being equal but opposite to the second feedback factor.

2. Apparatus as claimed in claim 1 further comprising, fifth delay means, a third feedback circuit coupling an output of said fifth delay means to an input thereof to give a third feedback factor of less than 1, sixth delay means having the same delay as does said fifth delay means and which couples a third circuit point to the input of said fifth delay means, and a third transmission path coupling said third circuit point to the input of said fifth delay means so as to circumvent said sixth delay means, the ratio of the transmission factor of the signal path from said third circuit point to the input of said fifth delay means via said third transmission path to the transmission factor of the signal path from said third circuit point to the input of said fifth delay means via said sixth delay means being equal but opposite to the third feedback factor, the sixth delay means being constituted by a portion of the first delay means or an input portion of the sixth delay means being constituted by at least a portion of the first delay means.

3. Apparatus as claimed in claim 1 wherein said first feedback circuit comprises a subtractor circuit, an attenuator and an adder circuit connected in series circuit to form a loop from the output to the input of the first delay means, and said first transmission path includes said series circuit and means connecting an input of the subtractor circuit to said first circuit point.

4. Apparatus as claimed in claim 3 wherein said second feedback circuit comprises a second subtractor circuit, a second attenuator and a second adder circuit connected in a second series circuit to form a loop from the output to the input of the third delay means, and said second transmission path includes said second series circuit and means connecting an input of the second subtractor circuit to said second circuit point.

5. Apparatus as claimed in claim 1 wherein the second delay means comprises the third delay means and a first delay line section, a first adder circuit, means connecting the third delay means, the first delay line section, the first adder circuit and the first delay means in cascade to form said signal path from the first circuit point to the input of said first delay means via said second delay means, said first delay means, said third delay means and said first delay line section having respective delay times of $\tau_3$, $\tau_2$ and $\tau_3-\tau_2$, a second adder circuit, said fourth delay means comprising second and third delay line sections having respective delay times of $\tau_1$ and $\tau_2-\tau_1$ and connected in cascade with the second adder circuit between the second circuit point and the first circuit point to form said signal path from said second circuit point to the input of said third delay means via said fourth delay means.

6. Apparatus as claimed in claim 5 further comprising a fourth delay line section having a delay time $\tau_1$ and a third adder circuit connected in cascade between an input terminal and said second circuit point, a third feedback circuit coupling an output of the second delay line section to an input thereof via the third adder circuit, and a third transmission path coupling said input terminal to the second circuit point so as to bypass said fourth delay line section.

7. Apparatus as claimed in claim 1 wherein said first feedback circuit comprises a subtractor circuit, an attenuator and an adder circuit connected in series circuit to form a loop from the output to the input of the first delay means, and said first transmission path includes said series circuit and means connecting an input of the subtractor circuit to said first circuit point, and wherein said second feedback circuit comprises a second subtractor circuit, a second attenuator and a second adder circuit connected in a second series circuit to form a loop from the output to the input of the third delay means, and said second transmission path includes said second series circuit and means connecting an input of the second subtractor circuit to said second circuit point.

8. Apparatus as claimed in claim 7 wherein said fourth delay means, said second adder circuit, said second delay means, said first adder circuit and said first delay means are connected in cascade, in the order named, between said second circuit point and an output terminal.

9. Artificial reverberation apparatus comprising first delay means, a first feedback circuit coupling an output of said first delay means to an input thereof to give a feedback factor of less than 1, second delay means having the same delay as does said first delay means and which couples a first circuit point to the input of said first delay means, a first transmission path coupling said first circuit point to the input of said first delay means so as to circumvent said second delay means, the ratio of the transmission factor of the signal path from said first circuit point to the input of said first delay means via said first transmission path to the transmission factor of the signal path from said first circuit point to the input of said first delay means via said second delay means being equal but opposite to said feedback factor, third delay means which includes said second delay means, a second feedback circuit coupling an output of said third delay means to an input thereof to give a second feedback factor of less than 1, fourth delay means having the same delay as does said third delay means and which couples a second circuit point to the input of said third delay means, and a second transmission path which couples said second circuit point to the input of said third delay means so as to circumvent said fourth delay means, the ratio of the transmission factor of the signal path from said second circuit point to the input of said third delay means via said second transmission path to the transmission factor of the signal path from said second circuit point to the input of said third delay means via said fourth delay means being equal but opposite to the second feedback factor.

10. Apparatus as claimed in claim 9 further comprising fifth delay means, a third feedback circuit coupling an output of said fifth delay means to an input thereof to give a third feedback factor of less than 1, sixth delay means having the same delay as does said fifth delay means and which couples a third circuit point to the input of said fifth delay means, and a third transmission path coupling said third circuit point to the input of said fifth delay means so as to circumvent said sixth delay means, the ratio of the transmission factor of the signal path from said third circuit point to the input of said fifth delay means via said third transmission path to the transmission factor of the signal path from said third circuit point to the input of said fifth delay means via said sixth delay means being equal but opposite to the third feedback factor, and wherein the sixth delay means comprises a portion of the first delay means.

11. Apparatus as claimed in claim 9 wherein said first feedback circuit comprises a subtractor circuit, an attenuator and an adder circuit connected in series circuit to form a loop from the output to the input of the first delay means, and said first transmission path includes said series circuit and means connecting an input of the subtractor circuit to said first circuit point.

12. Apparatus as claimed in claim 11 wherein said second feedback circuit comprises a second subtractor circuit, a second attenuator and a second adder circuit connected in a second series circuit to form a loop from the output to the input of the third delay means, and said second transmission path includes said second series circuit and means connecting an input of the second subtractor circuit to said second circuit point.

13. Apparatus as claimed in claim 9 wherein the first delay means includes first and second delay line sections connected in cascade, a first subtractor circuit, a first attenuator, a first adder circuit, means connecting the first subtractor circuit, the first attenuator and the first adder circuit in a first series circuit between an output of the second delay line section and an input of the first delay line section to form said first feedback circuit, said third delay means comprising said second delay means and a third delay line section in cascade, a second subtractor circuit, a second attenuator, a second adder circuit, means connecting the second subtractor circuit, the second attenuator and the second adder circuit in a second series circuit between an output of the third delay line section and an input of the second delay means to form said second feedback circuit, said second circuit point being connected to said input of the second delay means via the cascade connection of the fourth delay means and the second adder circuit and to an input of the second subtractor circuit.

14. Apparatus as claimed in claim 13 wherein a junction point between the second delay means and the third delay section is coupled to an input of the first delay section via the first adder circuit and a junction point between the first and second delay line sections is coupled to an output terminal via a further delay means.

15. Artificial reverberation apparatus comprising first delay means, a first feedback circuit coupling an output of said first delay means to an input thereof to give a feedback factor of less than 1, second delay means having the same delay as does said first delay means and which couples a first circuit point to the input of said first delay means, a first transmission path coupling said first circuit point to the input of said first delay means so as to bypass said second delay means, the ratio of the transmission factor of the signal path from said first circuit point to the input of said first delay means via said first transmission path to the transmission factor of the signal path from said first circuit point to the input of said first delay means via said second delay means being equal but opposite to said feeback factor, third delay means, a second feedback circuit coupling an output of said third delay means to an input thereof to give a second feedback factor of less than 1, fourth delay means having the same delay as does said third delay means and which couples a second circuit point to the input of said third delay means, and a second transmission path which couples said second circuit point to the input of said third delay means so as to bypass said fourth delay means, the ratio of the transmission factor of the signal path from said second circuit point to the input of said third delay means via said second transmission path to the transmission factor of the signal path from said second circuit point to the input of said third delay means via said fourth delay means being equal but opposite to the second feedback factor.

16. Apparatus as claimed in claim 15 wherein said fourth delay means comprises an input portion of the third delay means.

17. Apparatus as claimed in claim 15 wherein the second delay means comprises said third delay means and a delay line section in cascade connection, and means connecting said fourth delay means, a first adder circuit, said third delay means, said delay line sections, a second adder circuit and said first delay means in cascade between said second circuit point and an output terminal.

* * * * *